US005957392A

United States Patent [19]

Pincus

[11] Patent Number: 5,957,392

[45] **Date of Patent: *Sep. 28, 1999**

[54] NOZZLE FOR A LIQUID AGRICULTURAL CHEMICAL

[76] Inventor: David Pincus, 153 Penns Wood Dr., Newtown, Pa. 18940

[ * ] Notice: Under 35 U.S.C. 154(b), the term of this patent shall be extended for 1 day.

[21] Appl. No.: 09/004,664

[22] Filed: Jan. 8, 1998

[51] Int. Cl.[6] ..... B05B 1/14; B05B 1/26

[52] U.S. Cl. ..... 239/548; 239/502; 239/518; 239/559; 239/567

[58] Field of Search ..... 239/500, 502, 239/518, 544, 548, 559, 567, DIG. 1

[56] References Cited

U.S. PATENT DOCUMENTS

| | | | |
|---|---|---|---|
| 2,347,123 | 4/1944 | Riesgo | 239/548 X |
| 2,663,591 | 12/1953 | Pew | 239/548 |
| 2,726,897 | 12/1955 | Dupont | 239/559 X |
| 2,812,213 | 11/1957 | Bede | 239/544 |
| 2,898,093 | 8/1959 | Severson | 239/548 X |
| 2,964,248 | 12/1960 | O'Brien et al. | 239/544 |
| 4,347,981 | 9/1982 | Hayes | 239/500 |
| 5,826,798 | 10/1998 | Schindler et al. | 239/548 X |

FOREIGN PATENT DOCUMENTS

| | | | |
|---|---|---|---|
| 2811697 | 9/1979 | Germany | 239/567 |

*Primary Examiner*—Andres Kashnikow
*Assistant Examiner*—Robin O. Evans
*Attorney, Agent, or Firm*—FMC Corporation

[57] ABSTRACT

Nozzle for a liquid applicator which may be employed to apply a liquid, especially a sprayable herbicide are provided. The nozzles comprise a body having a first end, second end, and relative central horizontal axis. The body defines a bore which extends from the first end to a bore wall which is proximate the second end. The second end defines at least three exit openings which are spaced adjacent from one another. Each exit opening extends from the bore wall out through the second end at an angle between about 30 degrees to about 40 degrees relative to the horizontal central axis. Each one of the exit openings intersects a corresponding deflection surface which are formed in the second end. The first end is adapted to mechanically couple with an spray applicator.

5 Claims, 3 Drawing Sheets

NOZZLE FOR A LIQUID AGRICULTURAL CHEMICAL

FIELD OF THE INVENTION

The present invention relates to nozzles for applying herbicides to agricultural products, and more particularly to a nozzle that applies a liquid chemical in a predetermined spray pattern.

BACKGROUND OF THE INVENTION

Applicators for applying chemicals such as pesticides and herbicides to agricultural products are well known in the art. In the past, applicators were employed to apply solid chemicals above ground around agricultural plants and trees. Because these solid chemicals where above ground, nearby farm animals and birds could ingest these chemicals and become ill or die.

In an attempt to overcome this problem, liquid agricultural chemical applicators where developed. One such applicator 10 included in a closed loop liquid applicator system is shown in FIG. 1. In applying a liquid agricultural chemical, a portion of the applicator, the nozzle 12, had to be pushed below the soil such that the liquid agricultural chemical could be injected to an area proximate to the roots of the plant or tree. This applicator, however, had significant drawbacks.

One drawback is that it took a relatively long period of time to apply the liquid chemical. Each application of the liquid chemical required the operator to push the nozzle under the soil for every plant or tree. It would be highly desirable to provide an apparatus that reduces the time needed to apply a liquid herbicide to plants and/or trees.

Another drawback of conventional liquid applicators is that the operator is required to exert a relatively large amount energy when pushing the nozzle underground. This operation quickly exhausts operators of their strength after applying the chemical to a number of plants or trees. It would, therefore, be desirable to provide an apparatus for applying a liquid agricultural chemical that requires less effort than conventional liquid applicators.

SUMMARY OF THE INVENTION

Nozzles for a liquid applicator which may be employed to apply a liquid are provided. The nozzles comprise a body having a first end, second end, and relative central horizontal axis. The body defines a bore which extends from the first end to a bore wall which is proximate the second end. The second end defines at least three exit openings which are spaced adjacent from one another. Each exit opening extends from the bore wall out through the second end at an angle between about 30 degrees to about 40 degrees relative to the horizontal central axis. Each one of the exit openings intersects a corresponding deflection surface which formed in the second end. The first end is adapted to mechanically couple with an spray applicator.

DETAILED DESCRIPTION OF PREFERRED EMBODIMENT

Figure 2:
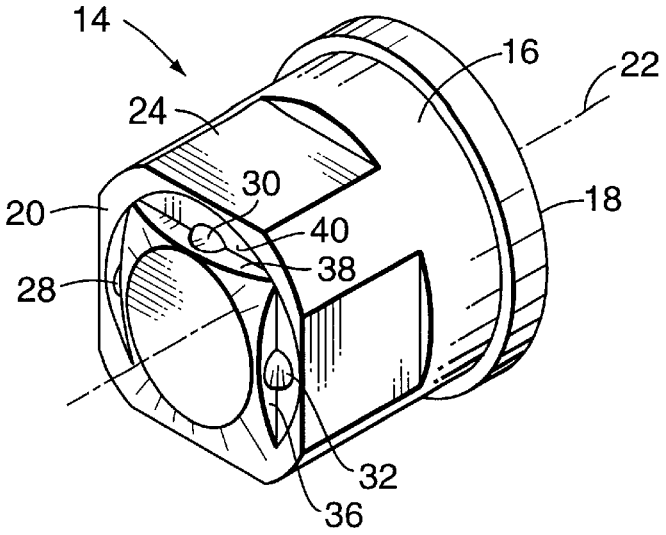
FIG. 2 is a perspective view of a preferred embodiment of a nozzle tip in accordance with the present invention.
Figure 3:
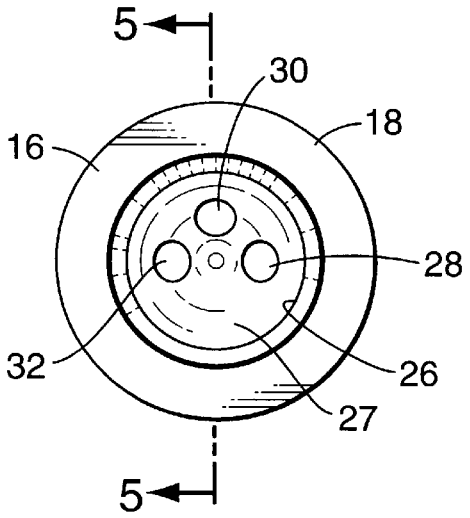
FIG. 3 illustrates a first end of the nozzle tip shown in FIG. 2.
Figure 4:
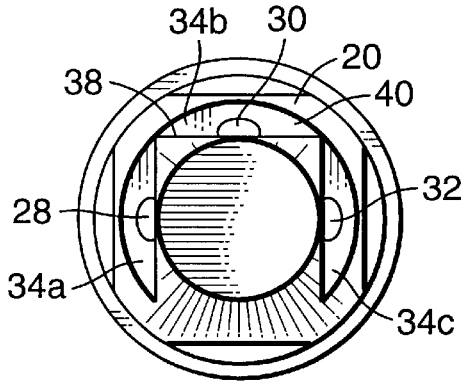
FIG. 4 illustrates a second end of the nozzle tip shown in FIG. 2.

FIGS. 2 through 4 illustrate a liquid chemical nozzle 14 in accordance with the present invention. The nozzle 14 is preferably adapted to be employed with a liquid applicator (not shown) to apply a liquid herbicide or pesticide, such as liquid RUGBY. The nozzle 14 comprises a body 16 having a first end 18 (FIGS. 2 and 3), second end 20 (FIGS. 2 and 4), and relative central horizontal axis 22. The first end 18 is adapted to mechanically couple with a spray applicator. The first end 18 may be adapted to be threaded, slip fit, or the like onto each liquid spray applicator. The body 16 has an outer surface 24 which is preferably adapted to cooperate with a tool, such as a wrench, to attach the nozzle to the spray applicator.

Figure 5:
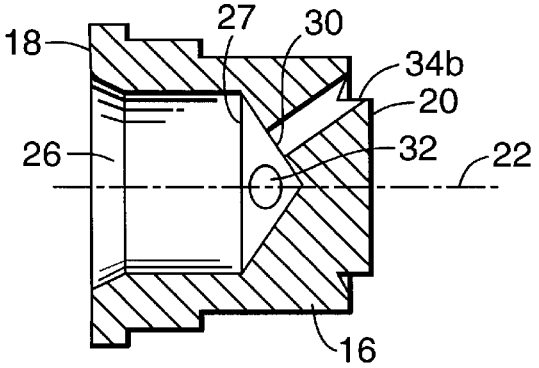
FIG. 5 is a cross sectional view taken along section line 5—5 shown in FIG. 3.

Referring to FIGS. 3 and 5, the body 16 defines a bore 26 which extends from the first end 18 to a bore wall 27 which is proximate said second end 20. Preferably, the bore 26 has a generally cylindrical cross-section which is adapted to enable the liquid to enter the first end and exit the second end. Preferably, the nozzle is made of a material, such as metal that will not corrode or degrade when used with a particular herbicide or pesticide.

Referring to FIGS. 2 through 5, the second end 20 defines at least three adjacent exit openings 28, 30, and 32 and at least three deflection surfaces 34*a*, 34*b*, and 34*c*. The first exit opening 28 is located at a first location which is spaced from the second exit opening 30 at a relative angle axially with respect to horizontal axis 22, between about thirty degrees to about forty degrees, and preferably about thirty-five degrees. The third exit opening 32 is spaced from the second exit opening 30 at another location which is spaced from the second exit opening at a relative angle between about thirty degrees to about forty degrees, and preferably about thirty degrees. The first and third exit openings 28 and 32 are preferably spaced generally opposite one another. Preferably, as shown in FIGS. 2 through 4, the first exit opening 28 is axially spaced approximately 90 degrees relative to the central horizontal axis from the second exit opening 30 and the third exit opening 32 is axially spaced approximately 90 degrees relative to the central horizontal axis from the second opening. Each one of the exit openings extends from the bore wall 27, out towards the second end 20, and intersects a corresponding deflection surface. Preferably, each one of the exit openings extends from the bore wall at an elevational angle of about twenty-five degrees to about forty degrees, and preferably about thirty degrees relative to the central horizontal axis 22.

Figure 1:
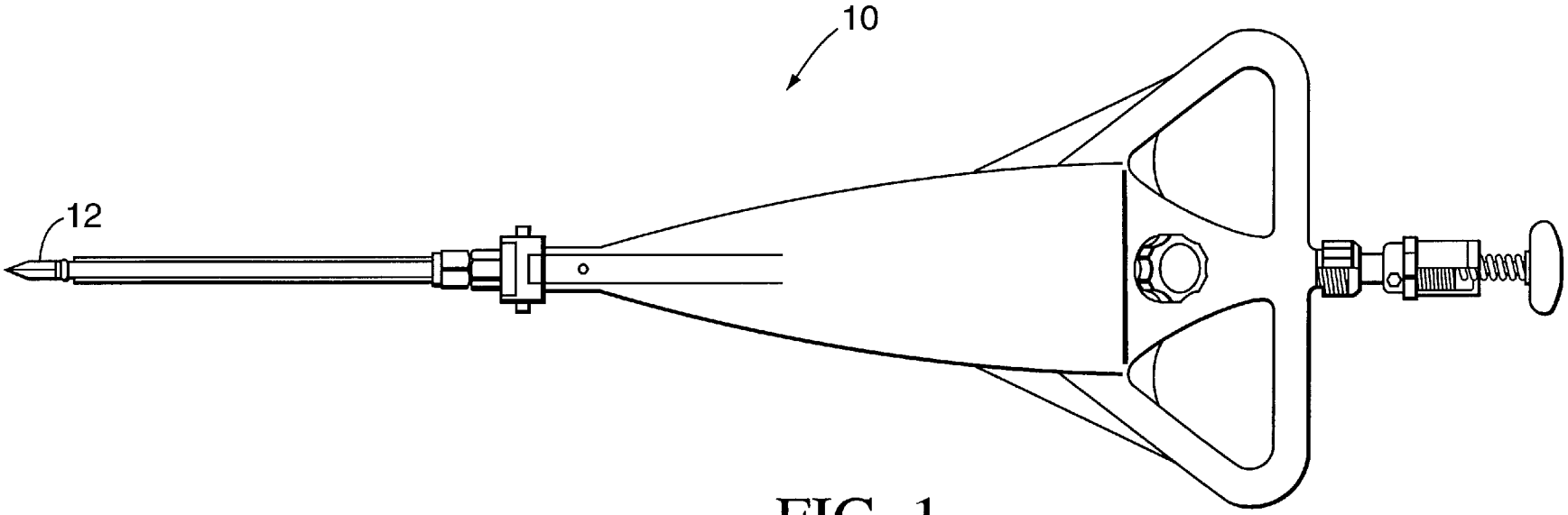
FIG. 1 PRIOR ART
FIG. 1 illustrates a prior art liquid herbicide applicator that has a nozzle that is inserted underground to apply a liquid herbicide.

The deflection surfaces 34*a*, 34*b*, and 34*c* are shown in more detail in FIGS. 1 and 4. Preferably, each deflection surface is defined by an oblong concave slot 36 which has a first spray surface 38 and a second spray surface 40. Preferably, each exit opening 28, 30, and 32 intersects a corresponding first spay surface 38 and second spray surface 40. Preferably, each exit opening and deflection surface is formed to produce a liquid RUGBY spray pattern for a banana tree.

Figure 6:
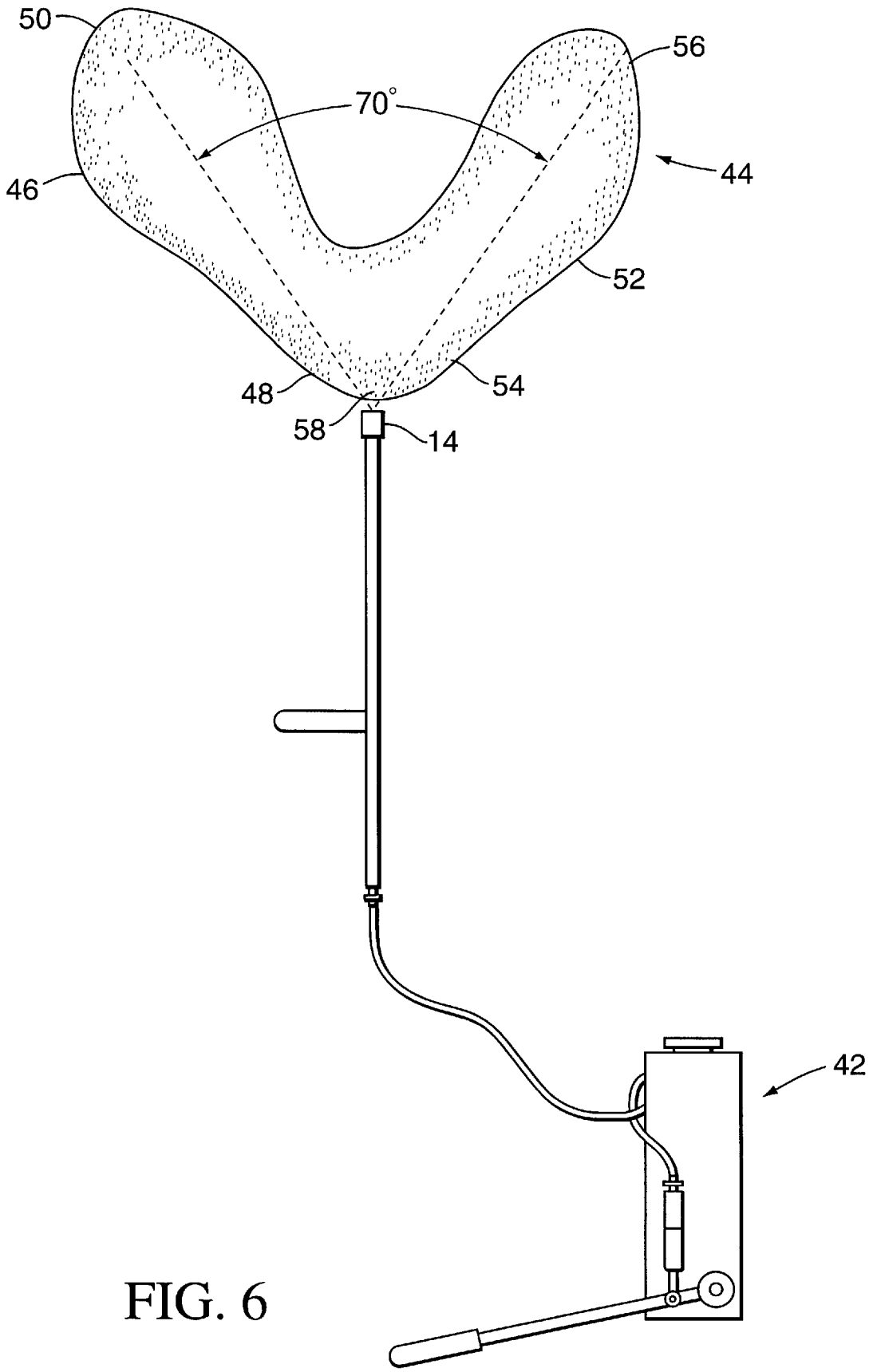
FIG. 6 illustrates the nozzle tip shown in FIG. 2 coupled with a liquid applicator and forming a spray pattern.

FIG. 6 illustrates a liquid spray applicator 42 coupled with the nozzle 14 which forms a preferred liquid spray pattern

44. The spray pattern 44 comprises a first leg 46 having a proximal end 48 and distal end 50. Additionally, the spray pattern 44 has a second leg 52 is formed having a proximal end 54 and distal end 56. The first and second legs are preferably connected at their respective proximal ends, thereby forming an apex 58. Preferably, the first and second legs extend to form an angle of from about 55–85, preferably about seventy degrees relative to the nozzle tip 14 horizontal axis 22.

In operation, the nozzle tip is coupled to a liquid spray applicator 42. As the liquid flows through the bore and through each exit opening, the liquid is deflected along respective deflection surfaces. As the liquid is deflected, the spray pattern is formed and surrounds a section of a particular plant, such as a banana plant or tree. Each leg of the spray pattern flows out towards two sides of a plant, as the apex flows to another relative frontal section of the plant. Over time, the liquid seeps through the soil, reaching the roots of the plant.

The present invention may be employed in other specific forms without departing from the spirit or essential attributes thereof. For example, any number of materials may be used in manufacturing the disclosed nozzle tip. While the invention has been described and illustrated with reference to specific embodiments, those skilled in the art will recognize that modification and variations may be made without departing from the principles of the invention as described hereinabove and set forth in the following claims.

I claim:

1. A nozzle for a liquid applicator which may be employed to apply a liquid, said nozzle comprising:

a body having a first end, second end, and relative central horizontal axis, said body defining a bore which extends from said first end to a bore wall which is proximate said second end, said second end defining at least three exit openings which are axially spaced adjacent from one another, each exit opening extending from the bore wall out through the second end at an elevational angle from the horizontal axis between about 30 degrees and about 40 degrees each one of said exit openings intersecting a corresponding deflection surface which is formed in said second end, said first end being adapted to mechanically couple with a spray applicator.

2. The spray nozzle of claim 1 wherein said first exit opening is axially spaced approximately 90 degrees relative to said central horizontal axis from said second exit opening, and said third exit opening is axially spaced approximately 90 degrees relative to said central horizontal axis from said second opening.

3. The spray nozzle in claim 1 wherein said deflection surfaces is an oblong concave surface which has a first spray surface and a second spray surface.

4. The spray nozzle in claim 3 wherein each exit opening intersects a corresponding first spray surface and second spray surface.

5. The spray nozzle in claim 1 wherein said nozzle is made of metal which is not corroded by said liquid.

* * * * *